United States Patent [19]

Luke

[11] 4,170,085

[45] Oct. 9, 1979

[54] DOLL WITH GROWING HAIR

[75] Inventor: Patrick Luke, Kowloon, Hong Kong

[73] Assignee: Mego Corp., New York, N.Y.

[21] Appl. No.: 799,684

[22] Filed: May 23, 1977

[51] Int. Cl.[2] ..... A63H 3/44

[52] U.S. Cl. ..... 46/135 R; 46/119

[58] Field of Search ..... 46/135 R, 172, 119, 46/161, 162

[56] References Cited

U.S. PATENT DOCUMENTS

| | | | |
|---|---|---|---|
| 3,162,976 | 12/1964 | Neebe et al. | 46/135 R |
| 3,706,155 | 12/1972 | Balza | 46/161 |

*Primary Examiner*—Louis G. Mancene

*Assistant Examiner*—Robert F. Cutting

*Attorney, Agent, or Firm*—Bertram Frank

[57] ABSTRACT

A doll with a lock of hair of adjustable length and a torso which has upper and lower portions which are rotatable relative to each other. The internal doll structure at the waist of the doll which permits the lock of hair to be adjustable in length, so as to simulate growing hair, is integral with the means at the waist which permits the torso portions to be rotatable relative to each other, e.g. the tube which holds the wound-up cord which displaces the lock of hair into the upper torso, also serves to hold the upper and lower torso portions together in slidable engagement.

15 Claims, 9 Drawing Figures

DOLL WITH GROWING HAIR

BACKGROUND OF THE INVENTION

1. Field of the Invention

The invention relates to growing hair dolls.

2. Description of the Prior Art

In the doll art, efforts to provide life-like features and appurtenances to the doll have been made for many years. Some of the many concepts and developments in this regard include crying or tearing dolls, wetting dolls, walking dolls, talking dolls, dolls that emit a sound when spanked or fondled, dolls with movable limbs or body members, dolls with interchangeable wigs, masks or costumes to simulate known personages or fictitious characters known to the child, and growing hair dolls. In this latter category the art has developed various configurations and structural arrangements, so that a child can manipulate a lock or tuft of the doll's hair, or even the entire hairpiece, in order to change the doll's appearance by lengthening or shortening the hair. Among the many prior art patents of this nature may be mentioned U.S. Pat. Nos. 3,765,123; 3,698,134; 3,696,552; 3,696,551; 3,694,957; 3,670,451; 3,477,170 (Reissue 27,267); 3,279,122; 3,225,489; 3,162,976; 3,156,999; 3,032,923; 2,537,536; 1,557,023 and 1,498,950; and British Pat. No. 1,363,496.

SUMMARY OF THE INVENTION

1. Purposes of the Invention

It is an object of the present invention to provide an improved doll.

Another object is to provide a doll with improved simulated life-like features.

An additional object is to provide an improved growing hair doll.

A further object is to provide a doll wherein not only the hair length but also the torso may be adjusted by manipulation.

Still another object is to provide a doll with hair of adjustable length.

Still a further object is to provide a doll with internal structure at the waist which permits not only modification of the length of the hair but also of the disposition of the torso portions.

Still an additional object is to provide a doll with hair that simulates real-life hair of a child or person that grows with time.

These and other objects and advantages of the present invention will become evident from the description which follows.

2. Brief Description of the Invention

The present invention relates specifically to a growing hair doll. At the onset, it will be understood that within the context of the present invention, the adjustable hair or hair portion will be in the form of a lock, a tuft, or strands of either natural or simulated artificial hair. If the hair is natural hair, it may be derived from a human being or an animal, such as woolen threads derived from sheep or horsehair. Simulated hair may alternatively consist of natural vegetable fiber such as cotton or linen, or artificial material such as threads of rayon, nylon etc. Thus, within the context of the present invention, the term hair will be understood to encompass and include any natural hair, or hair-like material of natural or synthetic origin; in the latter instance, simulated artificial hair is contemplated as being within the scope of the invention. Typical artificial fibers usable in the present invention, besides those mentioned supra, include Dynel, a polymer containing about 40% acrylonitrile and about 60% vinylchloride, Kanekalon, a fiber containing 40–45% acrylonitrile and 55–60% vinylchloride, and Teklan, a fiber containing about 49% each of acrylonitrile and vinylchloride and 2% of other monomers. As mentioned supra, nylon, poly (hexamethylene adipamide) may be used.

The present invention basically entails a combination of structural elements which permit adjustment of both the length of the doll's hair and the disposition or configuration of the torso of the doll. Thus the present doll has both a lock of hair of adjustable length and an adjustable torso. The doll includes a hollow head having an upper opening, a hollow upper torso and a hollow lower torso. Suitable means are provided to rotatably connect the doll's head to the upper end of the upper torso. A specific structural configuration is provided at the interface region between the upper torso and the lower torso. Thus the lower end of the upper torso is provided with an inner flange which extends inwards from the lower periphery of the upper torso and terminates with an inner periphery. A shelf is provided in the upper torso above the flange. The shelf extends inwards from the upper torso and terminates with an inner circular perimeter defining a circular opening. The upper end of the lower torso is also provided with an inner flange which is contiguous with the inner flange of the upper torso. The inner flange of the lower torso extends inwards from the upper periphery of the lower torso and terminates with a circular perimeter defining a circular opening. The circular openings of the aforementioned shelf and lower torso flange are coaxial and of equal diameter, so that these two circular openings serve to define a cylindrical passage. A cylindrical cord retention tube is disposed in and extends upwards through the cylindrical passage and is contiguous with the inner perimeters of the shelf and lower torso flange. Flanges are provided, at the upper and lower ends of the tube. These tube flanges extend outwards from the lower and upper end of the tube, respectively below and contiguous with the flange of the lower torso and above and contiguous with the aforementioned shelf of the upper torso. The side wall of the tube is provided with a pair of opposed circular openings which are coaxial with opposed hubs at the front and back of the upper torso. The hubs are between the shelf and the flange of the upper torso, and the lower perimeter of each hub is preferably tangential to the flange of the upper torso. The upper torso is provided with a lower peripheral opening adjacent to its flange and connecting with a hub, and a cylindrical rod or shaft extends through the hubs and opposed tube openings and terminates at the lower peripheral opening in the upper torso. An annular external flange is preferably provided on the rod, which flange is juxtaposed with the tube. Suitable means, e.g. a key, which are extendable through the lower peripheral opening in the upper torso and into the doll, are provided to rotate the rod or shaft. A cord, which may alternatively be a string, wire or chain, is provided inside the doll. The cord extends in a generally linear orientation within the upper torso when the adjustable lock of hair provided for the doll is fully extended out of the doll, and the cord is wound on the rod when the hair is shortened and a portion of the lock of hair is disposed within the upper torso, as will appear infra. In order to accomplish this alternative disposition of the lock of hair, one end of the cord is attached to the rod within the tube. The lock or tuft of hair which is provided consists generally of any one or a mixture of strands of the hair or hairlike material described supra. The other end of the cord is attached to the lock of hair, which lock extends upwards from attachment to the cord and through the upper opening in the doll's head. Thus, the length of the lock external to the head may be increased by a child, by manually grasping the lock and pulling the lock outwards from the head. The length of the lock external to the head may be decreased, and the lock may be at least partially retracted into the doll's head and upper torso, by manually rotating the rod, e.g. with a suitable key, so that the cord winds on the rod and pulls a portion of the lock through the head and into the upper torso. The structural configuration of flanges, shelf, tube and rod concomitantly permits the upper and lower torso portions to be slidably engaged so that these portions may be rotated relative to each other, thus providing an additional life-like simulation of a real person.

With regard to various specific aspects and preferred embodiments of the invention, in most instances the doll's head will have additional locks or tufts of hair permanently emplaced thereon, with the adjustable lock of hair extending from a centralized opening in the top of the head and being surrounded by these additional permanently emplaced locks of hair, so as to simulate the well-known "pony-tail" style of hair fashion. In order to rotatably connect the head to the upper torso, a preferred configuration entails an opening at the base of the head and a hollow protuberance at the upper end of the upper torso, with the protuberance extending into the head and preferably being provided with an enlargement or the like within the head for positive retention of the head on the upper torso. This enlargement typically is in the form of a bulbous terminus having upper and lower openings to accommodate the cord and the lock of hair.

The rod or shaft is preferably rotatable by means including a non-circular recess in the end of the rod which is adjacent the lower peripheral opening in the upper torso. The recess may be of rectangular, e.g. square, elliptical, triangular or hexagonal cross-section or of any other suitable configuration. In this case a key or key-like implement havng a handle and a shank is provided, with the shank of the key having a non-circular cross-section which mates with the cross-section of the recess, so that the shank of the key fits into the recess whereby rotation of the key rotates the rod. It is preferred that clockwise rotation of the key serves to rotate the rod, to wind the cord onto the rod and thereby to pull a portion of the lock of hair into the upper torso.

The upper opening of the head may be of any suitable configuration, e.g. circular, square, elliptical, oval, etc., however it is preferred that the opening be in the shape of a generally oblong, e.g. rectangular, slot, typically with curved corners, so that the lock of hair is distributed into a flat layer external to the doll, which lock is thus comparable to the well-known pony tail style of real-life women and girls. In this case the length of the slot, being greater than the width, will generally extend laterally relative to the doll, lengthwise from side to side of the head.

The present doll provides several salient advantages. The doll is pleasing to the child when played with, because of the close simulation of a real-life person, both because of the growing hair feature of the adjustable lock of hair and also because the torso and head may be manipulated. Thus the child may adjust the lock of hair to any suitable length, i.e. the hair may be made as long or as short as the child desires, and concomitantly the torso portions may be manipulated relative to each other. The hair and especially the adjustable lock of hair may be washed by the child, typically by using a mild shampoo and blowing dry with a hair dryer on the "cool" setting. The dry hair may be brushed or styled by a child as in real life. Thus, an improved doll with improved simulated life-like features has now been provided, and more specifically an improved growing hair doll is provided by the present invention. The present doll features not only adjustment of the length of the hair but also adjustment of the torso and head by manipulation by a child. Improved internal structure is provided at the waist of the doll which permits not only modification of the length of the hair but also concomitant modification of the disposition of the torso portions. Thus, an improved simulation of a real-life person with hair that grows with time and an adjustable body is attained in the present invention.

The invention accordingly consists in the features of construction, combination of elements and arrangement of parts which will be exemplified in the article of manufacture hereinafter described and of which the scope of application will be indicated in the appended claims.

BRIEF DESCRIPTION OF THE DRAWINGS

In the accompanying drawings in which is shown one of the various possible embodiments of the invention.

DETAILED DESCRIPTION OF THE PREFERRED EMBODIMENTS

Figure 1:
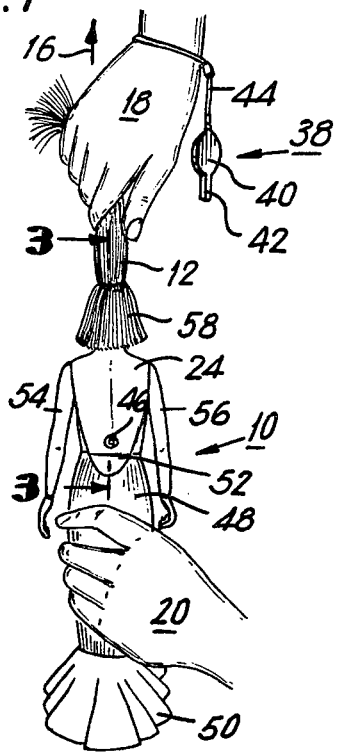
FIG. 1 is an overall elevation view of the doll being manipulated to lengthen the lock of hair.
Figure 3:
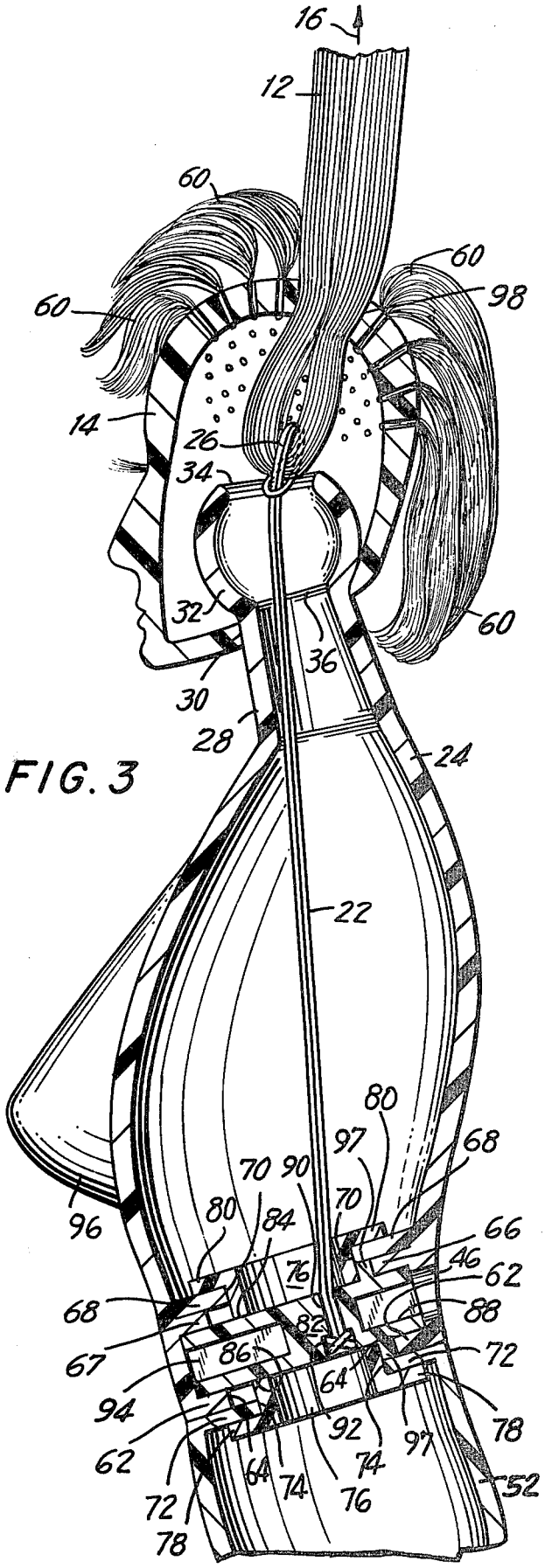
FIG. 3 is an enlarged sectional elevation view of major portions of the doll with the lock of hair fully extended out of the doll's body.

Referring now to FIGS. 1 and 3, a doll 10 of the present invention has a fully extended lock of hair 12. The lock or tuft 12 has been fully extended from hollow head 14 of the doll 10, in the direction indicated by arrow 16, by manually grasping the lock 12 with hand 18 of a person, such as a small child, playing with the doll 10, and pulling the lock 12 away from the body of the doll 10 while firmly holding the body of the doll in hand 20, until a cord 22 within the hollow upper torso 24 and head 14 of the doll is fully extended, as shown in FIG. 3.

The head 14, as shown in FIG. 3, is rotatably mounted on the upper torso 24 by the provision of foraminous means through which the upper end of the cord 22 extends to attachment to the lock 12 by means of upper loop 26. The rotatable mounting means in this case consists of a hollow protuberance 28 simulating the neck of the doll, which protuberance 28 extends through a lower opening 30 in the head 14 and terminates with an upper enlargement consisting of a bulbous terminus 32 having an upper opening 34 and a lower opening 36, so that the cord 22 and the lock 12 are accommodated by a clear passage between the head 14 and the upper torso 24.

FIG. 1 also shows a key 38 having a handle 40 and a shank 42, which shank 42 typically has a non-circular cross-section. The key 38 depends from a string or cord 44 by which the key 38 is detachably secured to the wrist of hand 18. When it is desired to retract the lock 12 into the head 14 and upper torso 24 of the doll 10, as will appear infra, the shank 42 is inserted through an opening 46 in the center of the back of the doll, which opening 46 is adjacent the lower perimeter of the upper torso. The doll 10 is shown in FIG. 1 wearing a dress 48 having a skirt 50. The dress 48 is a low cut gown, so that the upper portion of the lower torso 52 of the doll is shown. As shown in FIG. 3, the lower torso 52 is hollow, as was the case with the upper torso 24 and the head 14. FIG. 1 also shows the arms 54 and 56 of the doll 10, as well as permanently emplaced hair portion 58, which as shown in FIG. 3 consists of a plurality of locks of hair permanently emplaced in the head and designated as 60.

FIG. 3 also shows details of the structure of the waist of the doll, which structure is provided in accordance with the present invention. Referring first to the lower portion of the upper torso 24, the lower end of the upper torso portion 24 is provided with an inner flange 62, which extends inwards from the lower periphery of the upper torso 24 and terminates with an inner periphery 64 which defines an opening. A pair of opposed cylindrical hubs 66 and 67 are provided within the upper torso 24 above the flange 62; as will appear infra, the lower perimeter of each hub 66 or 67 is preferably tangential to the flange 62. A shelf 68 is provided within the upper torso 24 immediately above the hubs 66 and 67. Both the hubs 66 and 67 and the shelf 68 extend inwards from the inner perimeter of the upper torso portion 24. The shelf 68 terminates with a circular inner perimeter 70 which defines a circular opening.

Referring now to the lower torso portion 52, the upper end of the lower torso portion 52 is provided with an inner flange 72 which extends inwards from the upper periphery of torso portion 52 and terminates with a circular inner perimeter 74 defining a circular opening. A cylindrical cord retention tube 76 extends through the passage defined by the perimeters 70 and 74. A lower flange 78 extends outwards from the lower end of tube 76. Flange 78 is below and contiguous with flange 72. A similar flange 80 extends outwards from the upper end of the tube 76, and flange 80 is above and contiguous with the shelf 68. It is to be noted, in addition, that the outer perimeter of tube 76 is contiguous with the perimeters 70 and 74. Thus, the upper torso 24 and the lower torso 52 are slidably engaged, so that the lower torso 52 may rotate at least partially relative to the upper torso 24.

A cylindrical rod 82 extends transversely through opposed circular openings 84 and 86 in the side wall of the tube 76. The ends of the rod 82 are mounted in the hubs 66 and 67, respectively. The end of the rod 82 which is in the hub 66 is juxtaposed with the opening 46, so that suitable means such as the key 38 are extendable through opening 46 and into the typically non-circular recess or opening 88 in the end of the rod 82, so that the rod 82 may be rotated by the key 38 or the like.

The lower end of the cord 22 is attached to the rod 82, typically by having the lower end of cord 22 extend through a hole 90 in the rod 82 and terminate with a knot 92. Thus when the shank of the key 38 or the like is inserted into the non-circular recess 88 and the key 38 is rotated, the rod 82 rotates about its axis, and the cord 22 winds onto the rod 82, thus pulling the lock 12 downwards and into the head 14 and upper torso 24 of the doll 10.

Figure 2:
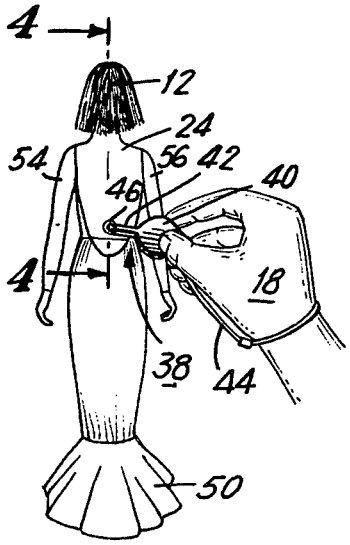
FIG. 2 is an elevation view of the doll showing insertion of a key to shorten the lock of hair.
Figure 4:
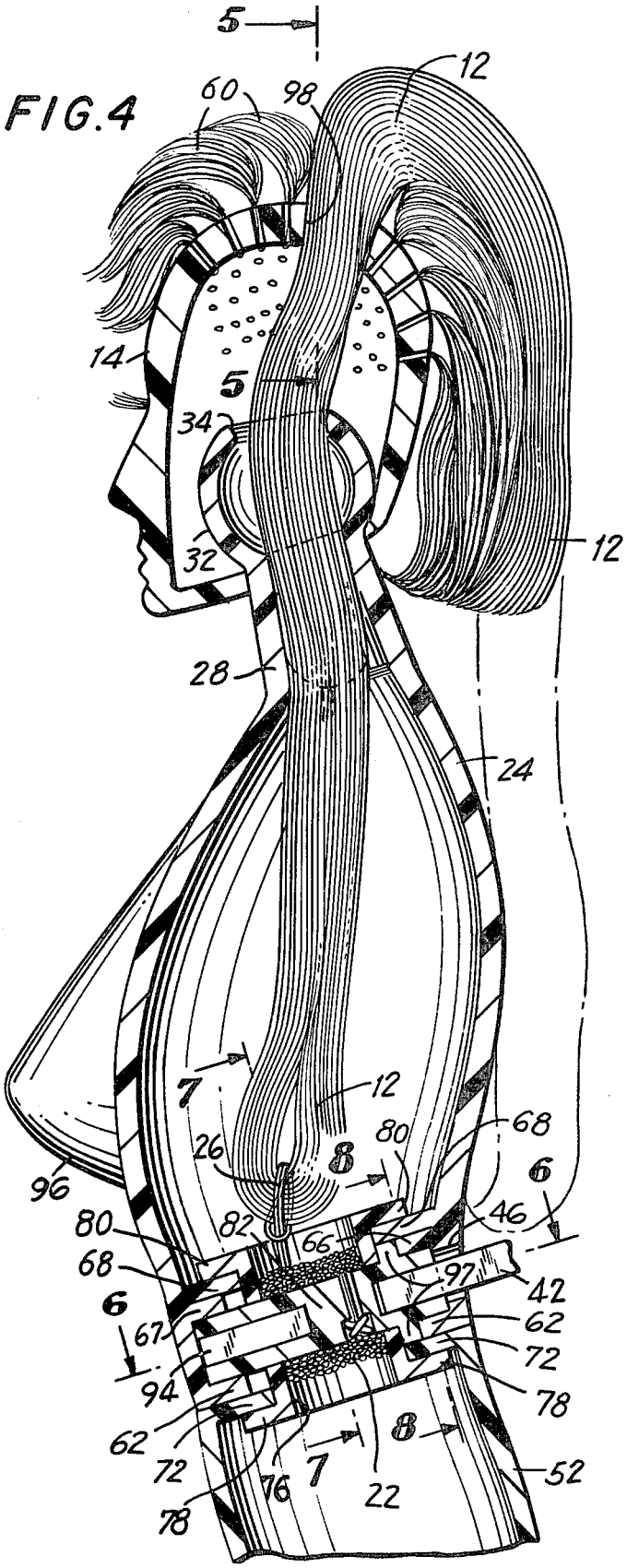
FIG. 4 is an enlarged sectional elevation view of major portions of the doll with the lock of hair fully retracted into the doll's body.

The sequence of retracting the lcok 12 into doll 10 is shown in FIGS. 2 and 4. As shown in FIG. 2, the shank 42 of the key 38 is manually inserted into opening 46. Since the recess 88 at the end of the rod 82 and the shank 42 are typically of a non-circular cross-section, e.g. square, rotation of the key 38, as shown in FIG. 4, can rotate the rod 82 and wind the cord 22 onto the rod 82, thus displacing the lock 12 into the head 14 and upper torso 24. This rotation of the rod 82 is preferably clockwise. As shown in full outline in FIG. 4, total winding of the cord 22 onto the rod 82 serves to displace the inner portion of the lock 12 downwards so that the end of the lock 12 defined by the loop 26 is juxtaposed with the tube 76. The other end of the lock 12 in this case is level with the balance of permanently emplaced locks of hair so as to simulate a short coiffure. The phantom outline of lock 12 in FIG. 4 shows partial displacement of the lock 12 into the doll.

FIGS. 2 and 4 also show an optional additional recess 94 at the end of the rod 82 opposite recess 88. This recess 94 is provided to lighten the weight of the rod 82 for easy manipulation by a child, and also to provide a flexible joint for the end of the rod 82 within hub 67, so that the rod 82 is easily rotatable.

FIGS. 3 and 4 also show a bust 96, typically provided when the doll 10 is intended to represent an adult female personage. FIGS. 3 and 4 further show a flange 97, which is an outer annular flange disposed on the rod 82 between the lower peripheral opening 64 in the upper torso 24 and the tube 76, i.e. the flange 97 is disposed between the hub 66 (and the flange 62), and the tube 76. Flange 97 serves to position the rod 82 and to prevent the rod 82 from being pushed against the front of upper torso 24 when the key shank 42 is inserted in recess 88.

Figure 5:
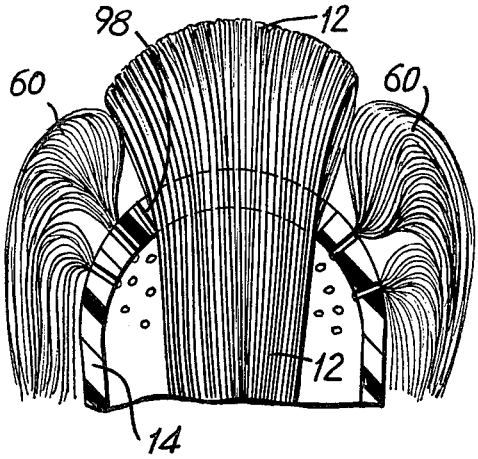
FIG. 5 is a sectional elevation view taken substantially along the lines 5—5 of FIG. 4.

FIG. 5 illustrates a typical configuration of an opening 98 in the head 14, through which the lock 12 extends out from the doll head. Thus the opening 98 is generally in the form of a slot, with the slot typically being generally oblong, and with the length of the slot extending laterally relative to the doll head 14.

Figure 6:
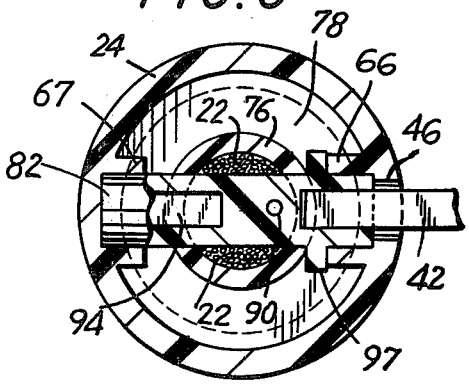
FIG. 6 is a sectional plan view taken substantially along the lines 6—6 of FIG. 4 and showing structural details at the waist of the doll.
Figure 7:
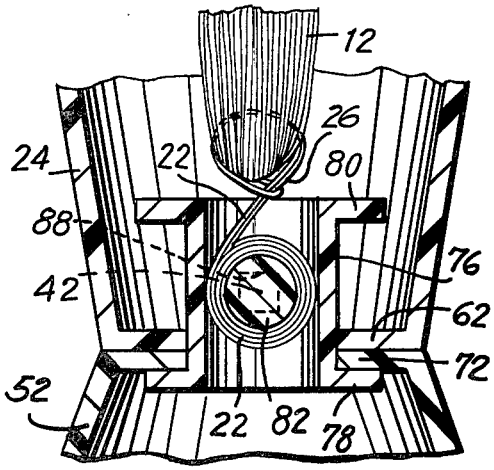
FIG. 7 is a sectional elevation view taken substantially along the lines 7—7 of FIG. 4 and showing structural details at the waist of the doll.
Figure 8:
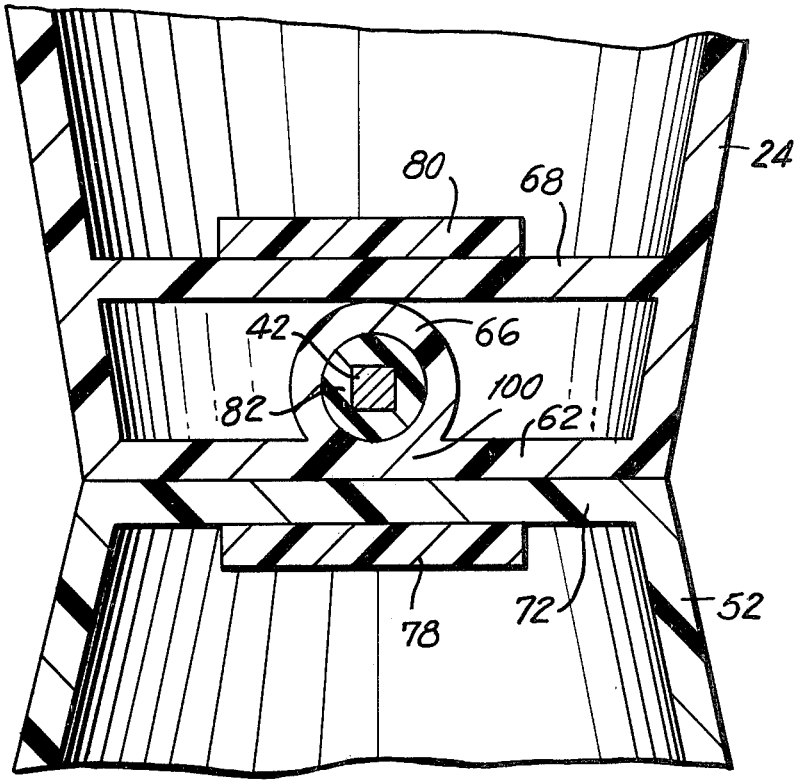
FIG. 8 is a sectional elevation view taken substantially along the lines 8—8 of FIG. 4 and showing structural details at the waist of the doll.
Figure 9:
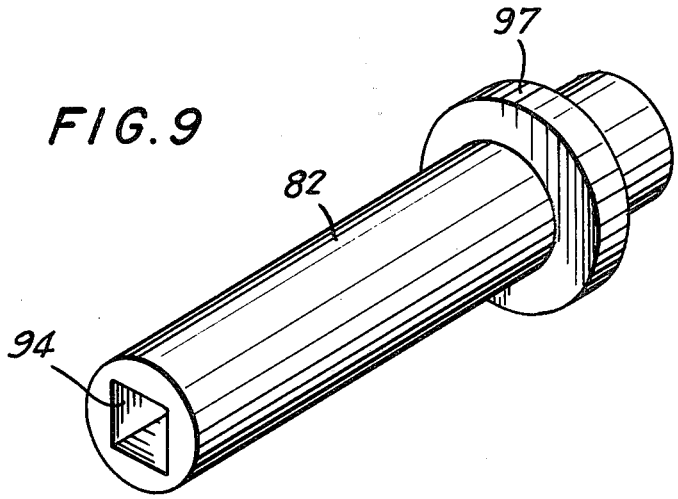
FIG. 9 is a perspective view of the rod.

FIGS. 6, 7, 8 and 9 show details of the configuration of the structure at the waist of the doll. Thus FIG. 6 illustrates the concentric circular nature of the tube 76 and upper torso 24; it will be appreciated that in practice upper torso portion 24 may be of non-circular cross-section, however in general members 76 and 24 will be coaxial. FIG. 7 illustrates the circular cross-section of rod 82 as well as a preferred square configuration of recess 88 as shown in phantom outline. FIG. 7 also shows the circular winding of cord 22 on rod 82. FIG. 8 illustrates the circular cross-section of the hub 66 as well as the coincident nature of the bottom of the hub 66 and the flange 62 at 100, i.e. the hub 66 is above and tangential to the flange 62. FIG. 8 also shows the square cross-section of the key shank 42, as well as the contiguous relationship between flange 80 and shelf 68 as well as between flange 78 and flange 72. FIG. 9 shows the disposition of flange 97 integral with rod 82.

It thus will be seen that there is provided an article of manufacture which achieves the various objects of the invention and which is well adapted to meet the conditions of practical use.

As various possible embodiments might be made of the above invention, and as various changes might be made in the embodiment above set forth, it is to be understood that all matter herein described or shown in the accompanying drawings is to be interpreted as illustrative and not in a limiting sense.

Having thus described the invention, there is claimed as new and desired to be secured by Letters Patent:

1. A doll having a lock of hair of adjustable length and an adjustable torso which comprises a hollow head having an upper opening, a hollow upper torso, and a hollow lower torso, foraminous means rotatably connecting said head to the upper end of said upper torso, so that a first passage is provided between said head and said upper torso, the lower end of said upper torso being provided with a first inner flange, said first inner flange extending inwards from the lower periphery of said upper torso and terminating with an inner periphery defining a first opening, the upper end of said lower torso being provided with a second inner flange contiguous with said first inner flange, so that the upper and lower torsos are slidably engaged and may be rotated relative to each other, said second inner flange extending inwards from the upper periphery of said lower torso and terminating with a circular inner perimeter defining a second opening, said second opening being circular and having a diameter less than and being substantially coaxial with said first opening so that said first and second openings define a second passage, a cylindrical cord retention tube separate from said upper and lower torsos, said tube being disposed in and extending upwards from said second passage, being contiguous with the inner perimeter of said second flange, and having a third flange at the lower end of said tube, said third flange extending outwards from the lower end of said tube below said second flange and being contiguous with said second flange, said tube being provided with a pair of opposed circular openings, said opposed circular openings being coaxial and above and substantially tangential to the upper surface of said first flange, said upper torso being provided with a lower peripheral opening adjacent to said first flange, a cylindrical rod, said rod extending through the opposed openings in said tube and terminating at the lower peripheral opening in said upper torso, means extendable through the lower peripheral opening in said upper torso and into said doll to rotate said rod, a cord within said upper torso, one end of said cord being attached to said rod within said tube, and a lock consisting of a plurality of strands of hair, the other end of said cord being attached to said lock, said lock extending through said upper opening in said head, so that the length of said lock external to said head may be increased by manually pulling said lock outwards from said head or decreased by rotating said rod whereby said cord winds on said rod and pulls a portion of said lock into said upper torso.

2. The doll of claim 1 in which the head has additional locks of hair permanently emplaced thereon.

3. The doll of claim 1 in which the means rotatably connecting the head to the upper end of the upper torso comprises an opening at the base of the head and a hollow protuberance at the upper end of the upper torso, said protuberance extending into said opening.

4. The doll of claim 3 in which the protuberance is provided with an enlargement within the head.

5. The doll of claim 4 in which the enlargement is in the form of a bulbous terminus having upper and lower openings to accommodate said cord and said lock.

6. The doll of claim 1 in which the upper opening of the head is in the form of a slot.

7. The doll of claim 6 in which the slot is generally oblong, and the length of the slot extends laterally relative to the doll.

8. The doll of claim 1 in which said rod is provided with an outer annular flange, said outer annular flange being disposed between the lower peripheral opening in the upper torso and the tube.

9. The doll of claim 1 in which a pair of opposed cylindrical hubs are provided within the upper torso above the first inner flange, one of said hubs circumscribing the lower peripheral opening in the upper torso, each end of the rod being disposed in one of said hubs.

10. The doll of claim 9 in which the lower perimeter of each hub is tangential to the first inner flange.

11. The doll of claim 1 in which a shelf is provided within the upper torso above the first inner flange, and an upper outer annular flange is provided at the upper end of the tube, said upper outer annular flange being above and contiguous with said shelf.

12. The doll of claim 11 in which the shelf terminates with a circular inner perimeter defining a third opening, the outer perimeter of the tube being contiguous with the inner perimeter of the shelf.

13. A doll having a lock of hair of adjustable length and an adjustable torso which comprises a hollow head having an upper opening, a hollow upper torso, and a hollow lower torso, foraminous means rotatably connecting said head to the upper end of said upper torso, so that a passage is provided between said head and said upper torso, the lower end of said upper torso being provided with a first inner flange, said first inner flange extending inwards from the lower periphery of said upper torso and terminating with an inner periphery defining a first opening, the upper end of said lower torso being provided with a second inner flange contiguous with said first inner flange, so that the upper and lower torsos are slidably engaged and may be rotated relative to each other, said second inner flange extending inwards from the upper periphery of said lower torso and terminating with a circular inner perimeter defining a second opening, said second opening being circular and having a diameter less than and being substantially coaxial with said first opening so that said first and second openings define a passage, a cylindrical cord retention tube, said tube being disposed in and extending upwards from said passage and being contiguous with the inner perimeter of said second flange, a third flange at the lower end of said tube, said third flange extending outwards from the lower end of said tube below said second flange and being contiguous with said second flange, said tube being provided with a pair of opposed circular openings, said opposed circular openings, being coaxial and above and substantially tangential to the upper surface of said first flange, said upper torso being provided with a lower peripheral opening adjacent to said first flange, a cylindrical rod extending through the opposed openings in said tube and terminating at the lower peripheral opening in said upper torso, said rod having a non-circular recess in its end which is adjacent the lower peripheral opening in the upper torso, means extendable through the lower peripheral opening in said upper torso and into said doll to rotate said rod, including a key having a handle and a shank, the shank of said key having a non-circular cross-section so that said shank fits into said non-circular recess, so that rotation of said key rotates said rod, a cord within said upper torso, one end of said cord being attached to said rod within said tube, and a lock consisting of a plurality of strands of hair, the other end of said cord being attached to said lock, said lock extending through said upper opening in said head, so that the length of said lock external to said head may be increased by manually pulling said lock outwards from said head or decreased by rotating said rod whereby said cord winds on said rod and pulls a portion of said lock into said upper torso.

14. The doll of claim 12 in which clockwise rotation of the key serves to rotate the rod to wind the cord onto the rod and thereby to pull a portion of the lock into the upper torso.

15. The doll of claim 12 in which the recess in the end of the rod and the shank of the key are square in cross-section.

* * * * *